US006277452B1

(12) United States Patent
Craig

(10) Patent No.: US 6,277,452 B1
(45) Date of Patent: Aug. 21, 2001

(54) TETHERED FORTUNE

(76) Inventor: Fernita D. Craig, 11300 White Water Dr., Bakersfield, CA (US) 93309

( * ) Notice: Subject to any disclaimer, the term of this patent is extended or adjusted under 35 U.S.C. 154(b) by 0 days.

(21) Appl. No.: 09/184,720

(22) Filed: Nov. 2, 1998

(51) Int. Cl.[7] ..... A47G 33/04

(52) U.S. Cl. ..... 428/7; 428/4; 428/5; 428/19; 428/21; 428/34.2; 428/34.3; 428/133; 428/542.2

(58) Field of Search ..... 428/5, 4, 8, 7, 428/21, 19, 12, 133, 34.2, 542.2, 34.3; 446/75; 206/232, 461, 462

(56) References Cited

U.S. PATENT DOCUMENTS

| | | | | |
|---|---|---|---|---|
| D. 335,943 | | 6/1993 | Shen | D01/127 |
| 3,403,106 | | 9/1968 | Story | 252/92 |
| 4,330,131 | * | 5/1982 | Warehime | 273/413 |
| 4,696,640 | | 9/1987 | Pitchford | 431/289 |
| 5,035,391 | * | 7/1991 | Steele et al. | 248/36 |
| 5,573,437 | * | 11/1996 | Van Dyke et al. | 446/75 |
| 5,603,993 | | 2/1997 | Ampomah | 428/7 |
| 5,645,902 | * | 7/1997 | Cheng | 428/5 |
| 5,670,219 | * | 9/1997 | Na | 428/8 |
| 5,714,211 | | 2/1998 | Zimbarg | 428/16 |
| 5,755,419 | * | 5/1998 | Gearhart et al. | 248/346.01 |

* cited by examiner

*Primary Examiner*—Deborah Jones
*Assistant Examiner*—Abraham Bahta

(57) ABSTRACT

A tethered fortune and charm assembly to permit easy retrieval from a cake, candle, package, game, balloon, pinata, table setting, Christmas decoration, party favor, card, flower arrangement, wedding garter or wedding bells and alert party guest or the receipient to the presents of an object at the end of the tether. An assembly consisting of a tether, to any of combination of a fortune and charm. The tether is attached to a combination of a fortune and charm or a fortune or charm with a fortune printed into or on plastic, metal, cardboard, paper, fibrous or non-fibrous tether, charm or any other medium, The charm can be plastic, metal, candy, or a printed engraved or embossed representation of a symbol or charm. The charm and fortune assembly can be sealed in a semi-hermetic or hermetically sealed package or lamination. With or without a self adhesive patch on the reverse side of the most exterior surface of the most significant portion.

4 Claims, 5 Drawing Sheets

TETHERED FORTUNE

BACKGROUND

1. Field of Invention

This invention relates to Articles for Decoration and Amusement, specifically a fortune used as a party favor, confetti, garnish, table setting, gift, or other novel applications.

2. Description of Prior Art

In the Philippine Islands charms are placed inside a wedding cake. The charms are made of plastic and painted gold. When the charm comes in direct contact with food a potential problem of food contamination exist. Another problem of a potential chocking hazard exist with the presence of the plastic charm laying loose inside the cake. In another application as a novelty in a candle, the problem of retrieving a hot object from a burning candle exists.

OBJECTS AND ADVANTAGES

Accordingly, several objects and advantages of my invention are to provide a tether arrangement for a fortune and charm combination. The tethered arrangement is economical, safe, reliable,easy to fabricate, and minimizes potential food contamination and chocking hazards. Moreover the arrangement can be assembled from various metals, plastic, paper, cardboard, or similar or composite materials or combinations of the same.

Still further objects and advantages will become apparent from a consideration of the ensuing description and accompanying drawings.

Figure 1:
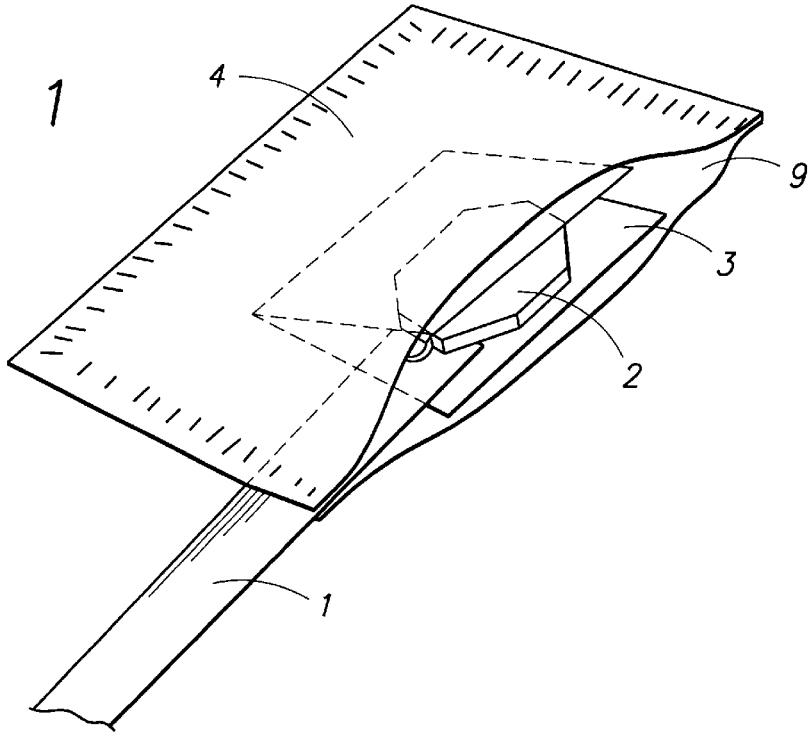
FIG. 1 is a partial sectional view of a soft package around a charm attached to a paper fortune to which a tether is attached to one end of the paper fortune and charm combination while the other end extends through the peripheral edges of the package.

| Reference Numerals | |
|---|---|
| 1 | tether |
| 2 | charm |

-continued

| Reference Numerals | |
|---|---|
| 3 | paper fortune |
| 4 | top assembly of the soft package |
| 5 | decorative end |
| 6 | rigid capsul |
| 7 | rigid surface |
| 8 | single rigid surface |
| 9 | bottom section of the soft package |

SUMMARY

An all occasion novelty ornament comprising: a base member, a single tether, and a package arrangement. The package arrangement comprising: two seperate film base elements bonded at the peripheral edges to form an enclosure for a paper sheet with an attached object of three dimensional quality and a tether attached to the paper sheet and charm and extending through one of the peripheral edges of the package arrangement. The free end of the tether is adorned with an ornament or decoration.

PREFERRED EMBODIMENT

Description

Figure 2:
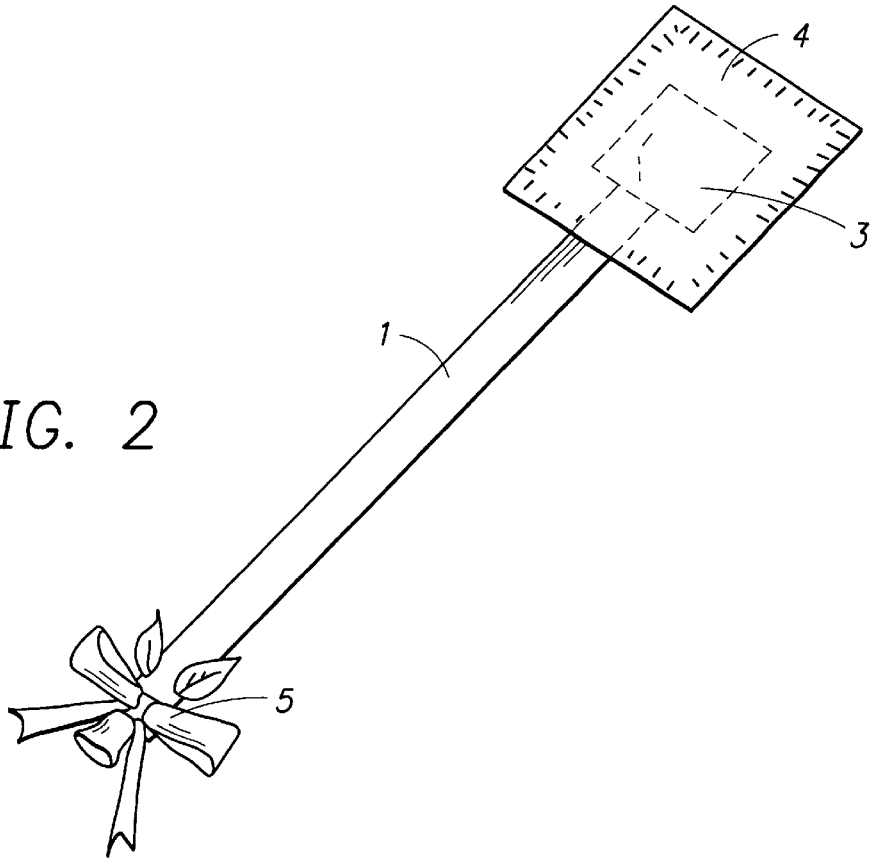
FIG. 2 is a top view of a complete assembly of the item in FIG. 1 showing a variation of the tether.
Figure 3:
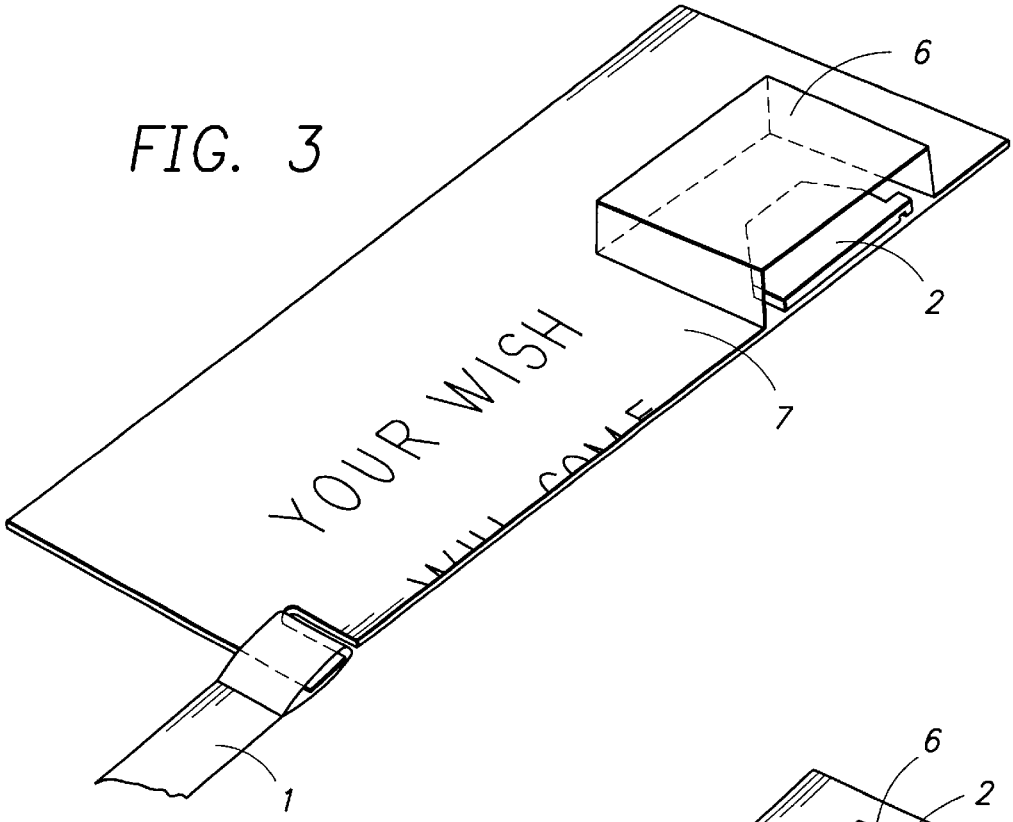
FIG. 3 is a partial sectional view of a rigid package containing the charm which is mounted to a rigid plate of cardboard, metal, plastic or similar construction material with printed, engraved, or embossed letters conveying words of wit, wisdom, fortune or instructions.
Figure 4:
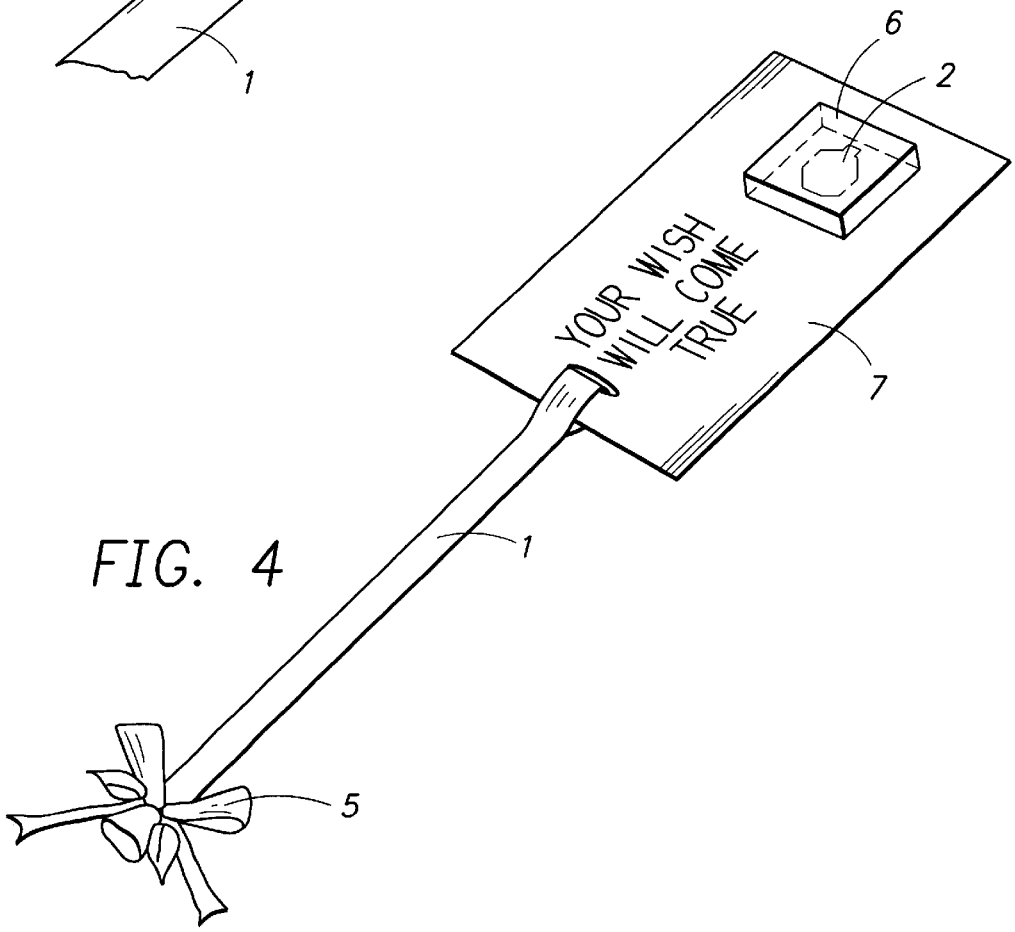
FIG. 4 is a a complete view of the item in FIG. 3 showing a variation of the tether.
Figure 5:
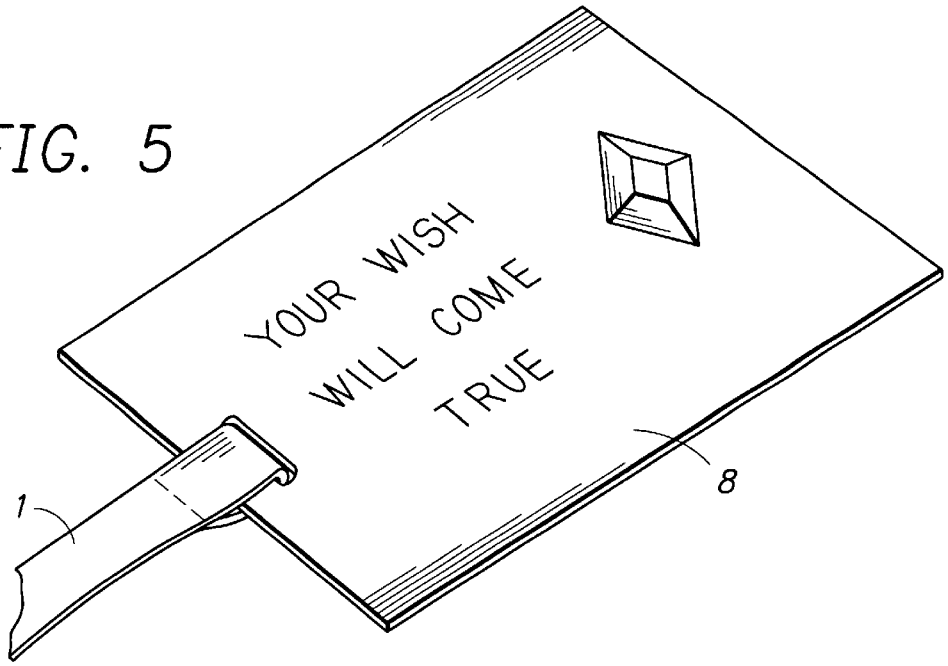
FIG. 5 is a top view of a plain rigid plate with the charm embedded, printed on, engraved, or embossed on the surface and showing the tether looped through a hole and bonded or fastened to itself.
Figure 6:
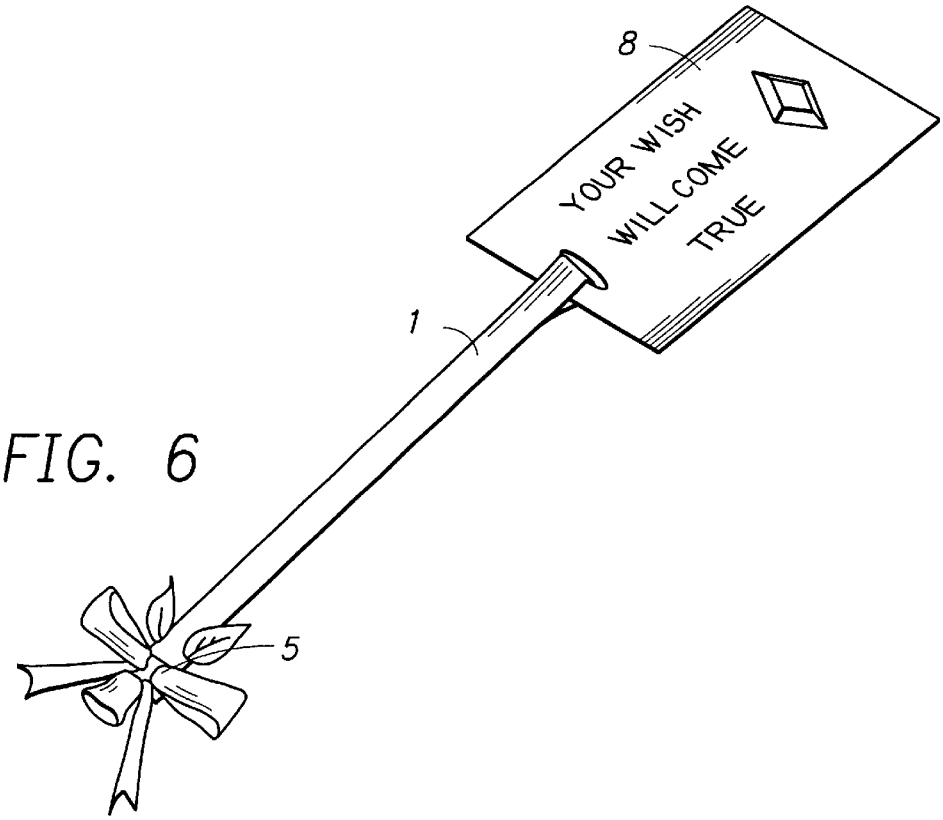
FIG. 6 is a top view of the complete item in FIG. 5 showing a variation of the tether.
Figure 7:
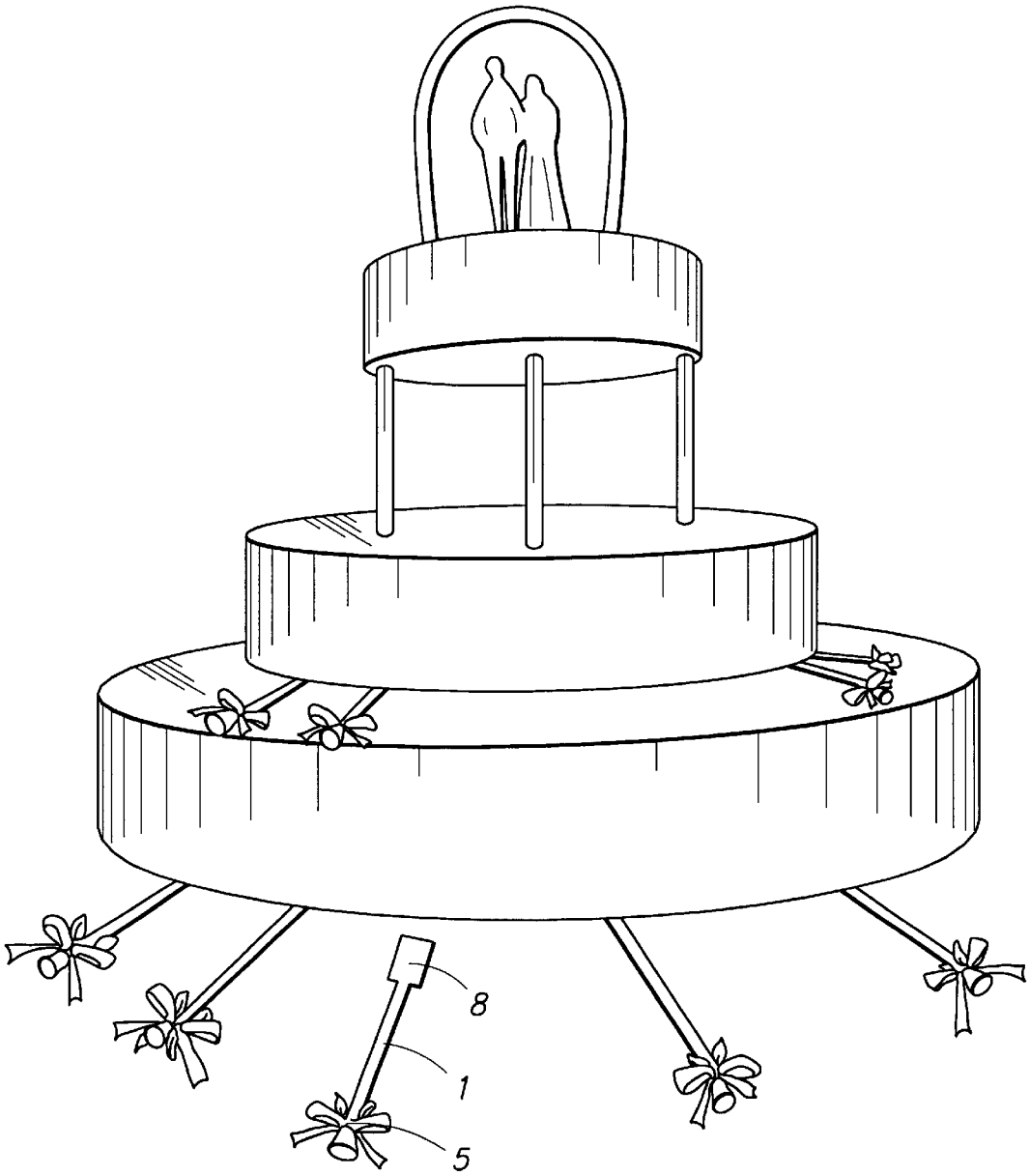
FIG. 7 shows an example of how the invention as illustrated in FIG. 6 may be used.
Figure 8:
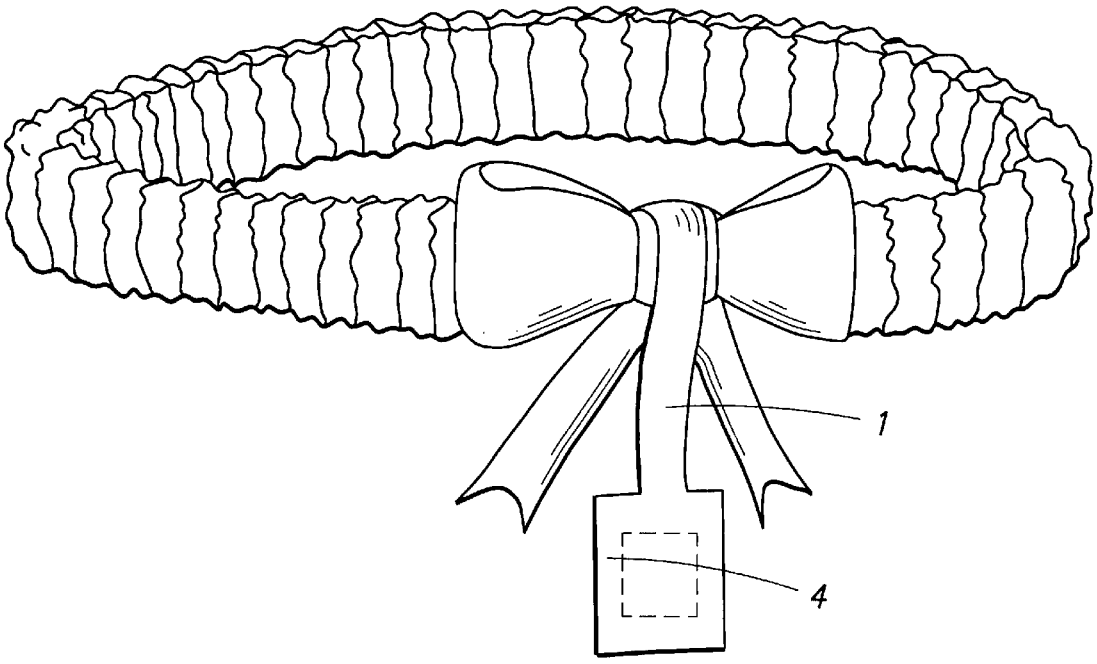
FIG. 8 shows An example of how the invention as illustrated in FIG. 2 may be used.

FIG. 1 shows a partial sectional view of a paper fortune 3 which is folded around a charm 2 having one end of a tether I attached to the paper fortune 3 and charm 2 and the other end extending through one of the peripheral edges of the top assembly of the soft package 4 which are bonded at the peripheral edges to the peripheral edges of the bottom section of the soft package 9 allowing a significan portion of the tether 1 to be exposed accordance with the invention. FIG. 2 shows a full view of the assembly of the item in FIG. 1 showing a variation of a decorative end 5 attached to the tether 1, the outter surface of the top edge of the top assembly of the soft package 4 and the bottom section of the soft package 9 and a phantom view of the paper fortune 3.

PREFERRED EMBODIMENT

Operation

Operation and use of the tethered arrangment of the invention is simple and straighforward. When the soft package assembled from the top assembly of the soft package 4 and the bottom section of the soft package 9 with the paper fortune 3 and charm 2 securely attached to the tether 1, is inserted into the side of a cake or placed under one of the layers or under the bottom of the cake it is concelled from view. The tether 1 is pulled to expose the soft package assembly. When the soft package assembly is opened it reveals a pleasant surprise in the form of a charm 2 and a message in the form of a paper fortune 3. The charm 2 and paper fortune 3 can be displayed or saved as a momento of the occasion when either are made from precious metals.

OTHER EMBODIMENTS

FIG. 3—Description

A rigid capsul 6 enclosing a charm 2 is bonded to a rigid surface 7. One end of a tether 1 is attached to one end of the rigid surface 7 in accordance with the invention.

FIG. 3—Operation

Operation and use of the tethered arrangement of the invention is simple and straighforward. The rigid capsul enclosing the charm is placed next to a place setting or stuck to the underside of a serving dish with the decorative end 5 end and a portion of the tether 1 in plain view. The obvious presence of the gift is apparent.

FIG. 4—Description

A rigid capsul 6, enclosing a charm 2, is bonded to a rigid surface 7 with one end of a tether 1 attached to one end of the rigid surface 7. A decorative end 5 adorns the other end of the tether 1 in accordance with the invention.

FIG. 4—Operation

Operation and use of the tethered arrangement to the invention is simple and straighforward. The rigid surface 7 is set as a place setting or stuck to the underside edge of a serving dish with a sperate temporary self adhesive patch (not shown) with the decorative end 5 and a portion of the tether 1 in plain view The guest pulls the decorative end 5 to reveal a single rigid surface 8 with a fortune or message printed on the surface.

FIG. 6—Description

A single rigid surface 8 with engraved, embossed, or printed letters and a symbol representing an object, place, or thing is attached to one end of a tether I whose other end is adorned with a decorative end 5 in accordance with the invention.

FIG. 6—Operation

Operation and use is simple and straighforward. The single rigid surface 8 is inserted into the side of a cake or stuck to the underside edge of a serving dish, with the decorative end 5 and a postion of the tether 1 exposed. When the guest pulls the decorative end 5 a novelty in the form of a charm and fortune combination is exposed.

CONCLUSIONS, RAMIFICATIONS, AND SCOPE

Accordingly, it can be seen that according to the invention, a tethered arrangement of a fortune and charm in a packaged vessle improves presentation and safety. As stated it can be used in a party favor to adorn a cake and be manufactured using existing technology. When properly bonded and sealed it will substantialy reduce the risk of potential food contamination and chocking hazard. Furthermore the charm can be worn as jewelry or the letters printed on the significant flat portion can contain instructions for games or be manufactured in the shape of a puzzle piece.

Although the description above contains many specificities, these should not be construed as limiting the scope of the invention but as merely providing illustrations of some of the presently preferred embodiments of this invention. Various other embodiments and ramifications are possible within it's scope. For example, A seperate playing board, similar to a "Pin The Tail on The Donkey" game, can be use at childrens parties. By pinning or pasting the tethered frotune within a specified target zone that is concelled from their view each player attempts to get the fortune he or she believes they want.

Thus the scope of the invention should be determined by the appended claims and their legal equivalents, rather than by the examples given.

What is claimed is:

1. A tethered fortune comprising: a package, a charm and paper fortune enclosed within the package, said package having a top film element and bottom film element bonded at the edges to form a waterproof enclosure for said charm and paper fortune, said package inserted within a cake and a tether attached to the package.

2. The tethered fortune of claim 1 further comprising a decoration attached at the opposite end of the tether.

3. A tethered fortune comprising: an enclosure for a charm comprising a capsule bonded to a rigid surface thereon, said rigid surface having an adhesive strip for adhering to the underside of a serving dish and a tether attached to the rigid surface.

4. The tethered fortune of claim 3 further comprising a decoration attached at the opposite end of the tether.

* * * * *